US010344978B2

(12) United States Patent
Godfrey et al.

(10) Patent No.: US 10,344,978 B2
(45) Date of Patent: Jul. 9, 2019

(54) COMBUSTION LINER COOLING

(71) Applicant: General Electric Company, Schenectady, NY (US)

(72) Inventors: Andrew Grady Godfrey, Simpsonville, SC (US); Christopher Paul Willis, Liberty, SC (US); David William Cihlar, Greenville, SC (US); David Philip Porzio, Greer, SC (US)

(73) Assignee: General Electric Company, Schenectady, NY (US)

( * ) Notice: Subject to any disclaimer, the term of this patent is extended or adjusted under 35 U.S.C. 154(b) by 344 days.

(21) Appl. No.: 15/070,110

(22) Filed: Mar. 15, 2016

(65) Prior Publication Data

US 2017/0268779 A1 Sep. 21, 2017

(51) Int. Cl.

| | |
|---|---|
| ***F23R 3/00*** | (2006.01) |
| ***F23R 3/02*** | (2006.01) |
| ***F23R 3/28*** | (2006.01) |

(52) U.S. Cl.

CPC ..... *F23R 3/005* (2013.01); *F23R 3/02* (2013.01); *F23R 3/283* (2013.01)

(58) Field of Classification Search

CPC .... F23R 3/00; F23R 3/002; F23R 3/02; F23R 3/54; F23R 3/005; F23R 3/283

See application file for complete search history.

(56) References Cited

U.S. PATENT DOCUMENTS

| | | | | |
|---|---|---|---|---|
| 8,826,667 | B2 | 9/2014 | Melton et al. | |
| 8,899,975 | B2 | 12/2014 | Khan et al. | |
| 8,919,127 | B2 * | 12/2014 | Melton | F23R 3/286 415/115 |
| 2015/0159872 | A1 | 6/2015 | Melton et al. | |

FOREIGN PATENT DOCUMENTS

| | | | |
|---|---|---|---|
| EP | 2 527 738 | A2 | 11/2012 |
| JP | S59-60127 | A | 4/1984 |

OTHER PUBLICATIONS

Extended European Search Report and Opinion issued in connection with corresponding EP Application No. 17160878.9 dated Jul. 24, 2017.

* cited by examiner

*Primary Examiner* — Craig Kim
(74) *Attorney, Agent, or Firm* — Dority & Manning, P.A.

(57) ABSTRACT

The present disclosure is directed to a combustor having an annularly shaped liner that at least partially defines a hot gas path of the combustor. A flow sleeve circumferentially surrounds at least a portion of the liner. The flow sleeve is radially spaced from the liner to form a cooling flow annulus therebetween. A bluff body extends radially between the flow sleeve and the liner through the cooling flow annulus. A guide vane is disposed within the cooling flow annulus and extends between the flow sleeve and the liner proximate to the bluff body.

15 Claims, 4 Drawing Sheets

COMBUSTION LINER COOLING

FIELD OF THE TECHNOLOGY

The subject matter disclosed herein relates to a combustor for a gas turbine. More specifically, the disclosure is directed to a system for cooling a combustion liner of a gas turbine.

BACKGROUND

Gas turbines usually burn hydrocarbon fuels and produce air polluting emissions such as oxides of nitrogen (NOx) and carbon monoxide (CO). Oxidization of molecular nitrogen in the gas turbine depends upon the temperature of gas located in a combustor, as well as the residence time for reactants located in the highest temperature regions within the combustor. Thus, the amount of NOx produced by the gas turbine may be reduced by either maintaining the combustor temperature below a temperature at which NOx is produced, or by limiting the residence time of the reactant in the combustor.

One approach for controlling the temperature of the combustor involves pre-mixing fuel and air to create a lean fuel-air mixture prior to combustion. This approach may include the axial staging of fuel injection where a first fuel-air mixture is injected and ignited at a first or primary combustion zone of the combustor to produce a main flow of high energy combustion gases, and where a second fuel-air mixture is injected into and mixed with the main flow of high energy combustion gases via a plurality of radially oriented and circumferentially spaced fuel injectors or axially staged fuel injectors positioned downstream from the primary combustion zone. Axially staged injection increases the likelihood of complete combustion of available fuel, which in turn reduces the air polluting emissions.

During operation of the combustor, it is necessary to cool one or more liners or ducts that form a combustion chamber and/or a hot gas path through the combustor. Liner cooling is typically achieved by routing a cooling medium such as the compressed air through a cooling flow annulus or flow passage defined between the liner and a flow sleeve and/or an impingement sleeve that surrounds the liner. However, in particular configurations, one or more bluff bodies such the axially staged fuel injectors or mounting hardware such as a mounting boss for the axially staged fuel injectors are disposed within the cooling flow annulus, thereby disrupting the cooling flow through the cooling flow annulus. Each bluff body creates a wake region just behind or downstream therefrom, thereby reducing overall cooling effectiveness of the cooling medium, particularly in the wake region.

BRIEF DESCRIPTION OF THE TECHNOLOGY

Aspects and advantages are set forth below in the following description, or may be obvious from the description, or may be learned through practice.

One embodiment of the present disclosure is directed to a combustor. The combustor includes an annularly shaped liner that at least partially defines a hot gas path of the combustor. A flow sleeve circumferentially surrounds at least a portion of the liner. The flow sleeve is radially spaced from the liner to form a cooling flow annulus therebetween. A bluff body extends radially between the flow sleeve and the liner through the cooling flow annulus. A guide vane is disposed within the cooling flow annulus and extends between the flow sleeve and the liner proximate to the bluff body.

Another embodiment of the present disclosure is directed to a combustor. The combustor includes an annularly shaped liner that at least partially defines a hot gas path of the combustor. A flow sleeve circumferentially surrounds at least a portion of the liner. The flow sleeve is radially spaced from the liner to form a cooling flow annulus therebetween. A bluff body extends radially between the flow sleeve and the liner through the cooling flow annulus. A plurality of guide vanes is disposed within the cooling flow annulus. Each guide vane of the plurality of guide vanes extends between the flow sleeve and the liner proximate to the bluff body.

Another embodiment includes a gas turbine engine. The gas turbine engine includes a compressor, a turbine and a combustor disposed downstream from the compressor and upstream from the turbine. The combustor includes an annularly shaped liner that at least partially defines a hot gas path of the combustor. A flow sleeve circumferentially surrounds at least a portion of the liner and the flow sleeve is radially spaced from the liner to form a cooling flow annulus therebetween. A bluff body extends radially between the flow sleeve and the liner through the cooling flow annulus. At least one guide vane is disposed within the cooling flow annulus and extends between the flow sleeve and the liner proximate to the bluff body.

Those of ordinary skill in the art will better appreciate the features and aspects of such embodiments, and others, upon review of the specification.

BRIEF DESCRIPTION OF THE DRAWINGS

A full and enabling disclosure of the of various embodiments, including the best mode thereof to one skilled in the art, is set forth more particularly in the remainder of the specification, including reference to the accompanying figures, in which.

DETAILED DESCRIPTION

Figure 1:
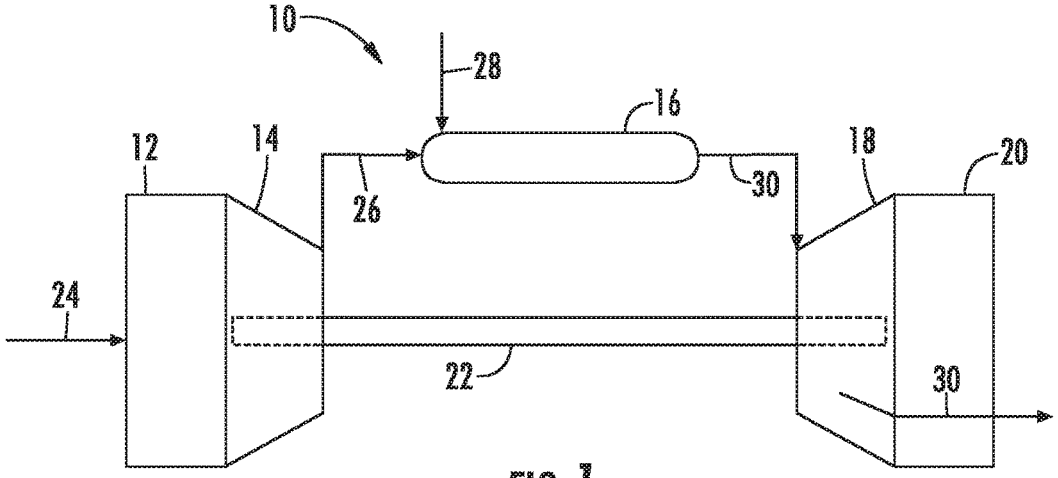
FIG. 1 is a functional block diagram of an exemplary gas turbine that may incorporate various embodiments of the present disclosure.

Reference will now be made in detail to present embodiments of the disclosure, one or more examples of which are illustrated in the accompanying drawings. The detailed description uses numerical and letter designations to refer to features in the drawings. Like or similar designations in the drawings and description have been used to refer to like or similar parts of the disclosure.

As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, the term "axially" refers to the relative direction that is substantially parallel and/or coaxially aligned to an axial centerline of a particular component and the term "circumferentially" refers to the relative direction that extends around the axial centerline of a particular component.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Each example is provided by way of explanation, not limitation. In fact, it will be apparent to those skilled in the art that modifications and variations can be made without departing from the scope or spirit thereof. For instance, features illustrated or described as part of one embodiment may be used on another embodiment to yield a still further embodiment. Thus, it is intended that the present disclosure covers such modifications and variations as come within the scope of the appended claims and their equivalents. Although exemplary embodiments of the present disclosure will be described generally in the context of a combustor for a land based power generating gas turbine combustor for purposes of illustration, one of ordinary skill in the art will readily appreciate that embodiments of the present disclosure may be applied to any style or type of combustor for a turbomachine and are not limited to combustors or combustion systems for land based power generating gas turbines unless specifically recited in the claims.

Referring now to the drawings, FIG. 1 illustrates a schematic diagram of an exemplary gas turbine 10. The gas turbine 10 generally includes an inlet section 12, a compressor 14 disposed downstream of the inlet section 12, at least one combustor 16 disposed downstream of the compressor 14, a turbine 18 disposed downstream of the combustor 16 and an exhaust section 20 disposed downstream of the turbine 18. Additionally, the gas turbine 10 may include one or more shafts 22 that couple the compressor 14 to the turbine 18.

During operation, air 24 flows through the inlet section 12 and into the compressor 14 where the air 24 is progressively compressed, thus providing compressed air 26 to the combustor 16. At least a portion of the compressed air 26 is mixed with a fuel 28 within the combustor 16 and burned to produce combustion gases 30. The combustion gases 30 flow from the combustor 16 into the turbine 18, wherein energy (kinetic and/or thermal) is transferred from the combustion gases 30 to rotor blades (not shown), thus causing shaft 22 to rotate. The mechanical rotational energy may then be used for various purposes such as to power the compressor 14 and/or to generate electricity. The combustion gases 30 exiting the turbine 18 may then be exhausted from the gas turbine 10 via the exhaust section 20.

Figure 2:
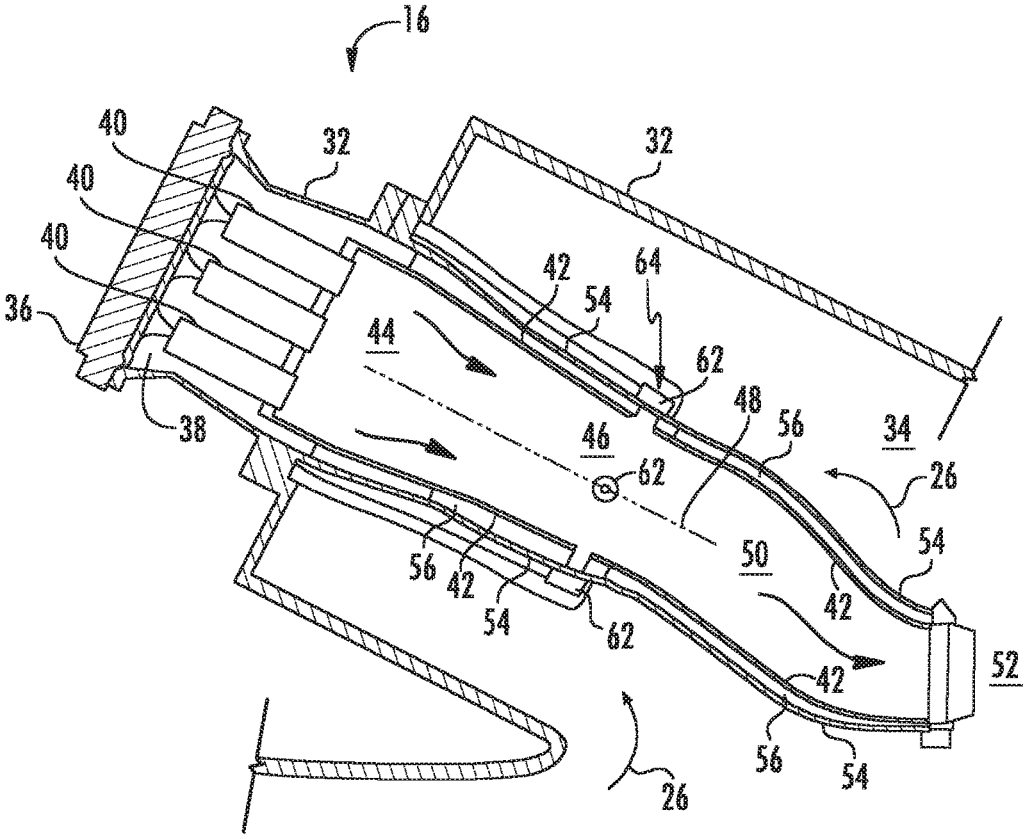
FIG. 2 is a simplified cross-section side view of an exemplary combustor as may incorporate various embodiments of the present disclosure.

As shown in FIG. 2, the combustor 16 may be at least partially surrounded an outer casing 32 such as a compressor discharge casing. The outer casing 32 may at least partially define a high pressure plenum 34 that at least partially surrounds various components of the combustor 16. The high pressure plenum 34 may be in fluid communication with the compressor 14 (FIG. 1) so as to receive the compressed air 26 therefrom. An end cover 36 may be coupled to the outer casing 32. In particular embodiments, the outer casing 32 and the end cover 36 may at least partially define a head end volume or portion 38 of the combustor 16. In particular embodiments, the head end portion 38 is in fluid communication with the high pressure plenum 34 and/or the compressor 14.

Fuel nozzles 40 extend axially downstream from the end cover 36. One or more annularly shaped liners or ducts 42 may at least partially define a primary or first combustion or reaction zone 44 for combusting the first fuel-air mixture and/or may at least partially define a secondary combustion or reaction zone 46 formed axially downstream from the first combustion zone 44 with respect to an axial centerline 48 of the combustor 16. The liner 42 at least partially defines a hot gas path 50 from the primary fuel nozzle(s) 40 to an inlet 52 of the turbine 18 (FIG. 1). In at least one embodiment, the liner 42 may be formed so as to include a tapering or transition portion. In particular embodiments, the liner 42 may be formed from a singular or continuous body. A flow or impingement sleeve 54 circumferentially surrounds at least a portion of the liner 42. The flow sleeve 54 is radially spaced from the liner 42 to form a cooling flow annulus 56 therebetween.

Figure 3:
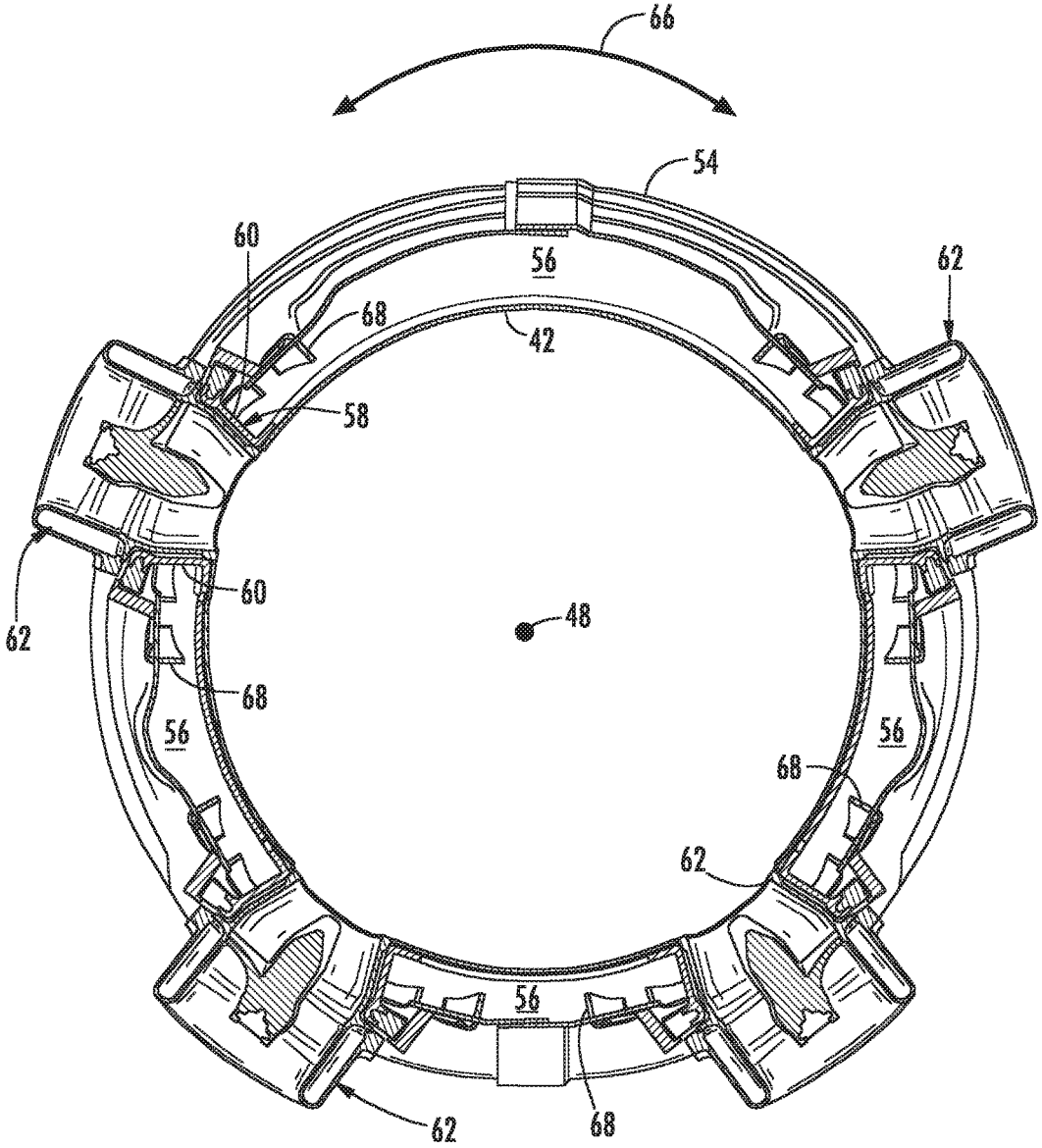
FIG. 3 is an upstream cross-sectional view of a portion of a combustor including a liner and a flow sleeve according to at least one embodiment of the present disclosure.

FIG. 3 provides a cross sectioned upstream view of a portion of the combustor 16 including a portion of an exemplary flow sleeve 54 and a portion of an exemplary liner 42. In at least one embodiment, at least one bluff body 58 may extend radially between the liner 42 and the flow sleeve 54 within the cooling flow annulus 56. For example, in at least one embodiment, the bluff body 58 may comprise of a boss or strut 60 that extends radially between the liner 42 and the flow sleeve 56 within the cooling flow annulus 56. In at least one embodiment, the bluff body 58 may comprise at least one fuel injector 62 that extends radially between the liner 42 and the flow sleeve 56 within the cooling flow annulus 56. In at least one embodiment, the boss or strut 60 may be used to mount or support the fuel injector 62.

As shown in FIGS. 2 and 3, the fuel injector(s) 62 may be part of an axially staged fuel injection system 64. The fuel injector(s) 62 of the axially staged fuel injection system 64 are axially staged or spaced from the primary fuel nozzle(s) 40 with respect to axial centerline 48. The fuel injector(s) 62 is disposed downstream of the primary fuel nozzle(s) 40 and upstream of the inlet 52 to the turbine 18. It is contemplated that a number of fuel injectors 62 (including two, three, four, five, or more fuel injectors 62) may be used in a single combustor 16. As shown in FIG. 3, the fuel injectors 62 may be spaced circumferentially about the perimeter of the liner 42 with respect to circumferential direction 66.

For simplicity, the axially staged fuel injection system 64 is referred to, and illustrated herein, as having multiple fuel injectors 62 in a single stage, or common axial plane, downstream of the primary combustion zone 44. However, it is contemplated that the axially staged fuel injection system 64 may include two axially spaced stages of fuel injectors 62. For example, a first set of fuel injectors and a second set of fuel injectors may be axially spaced from one another along the liner 42 and flow sleeve 54.

Figure 4:
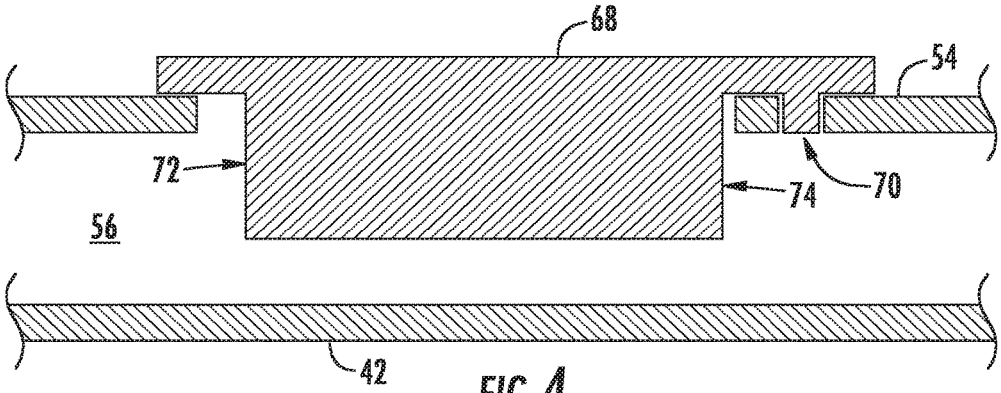
FIG. 4 is top view of the flow sleeve as shown in FIG. 3, according to at least one embodiment of the present disclosure.
Figure 5:
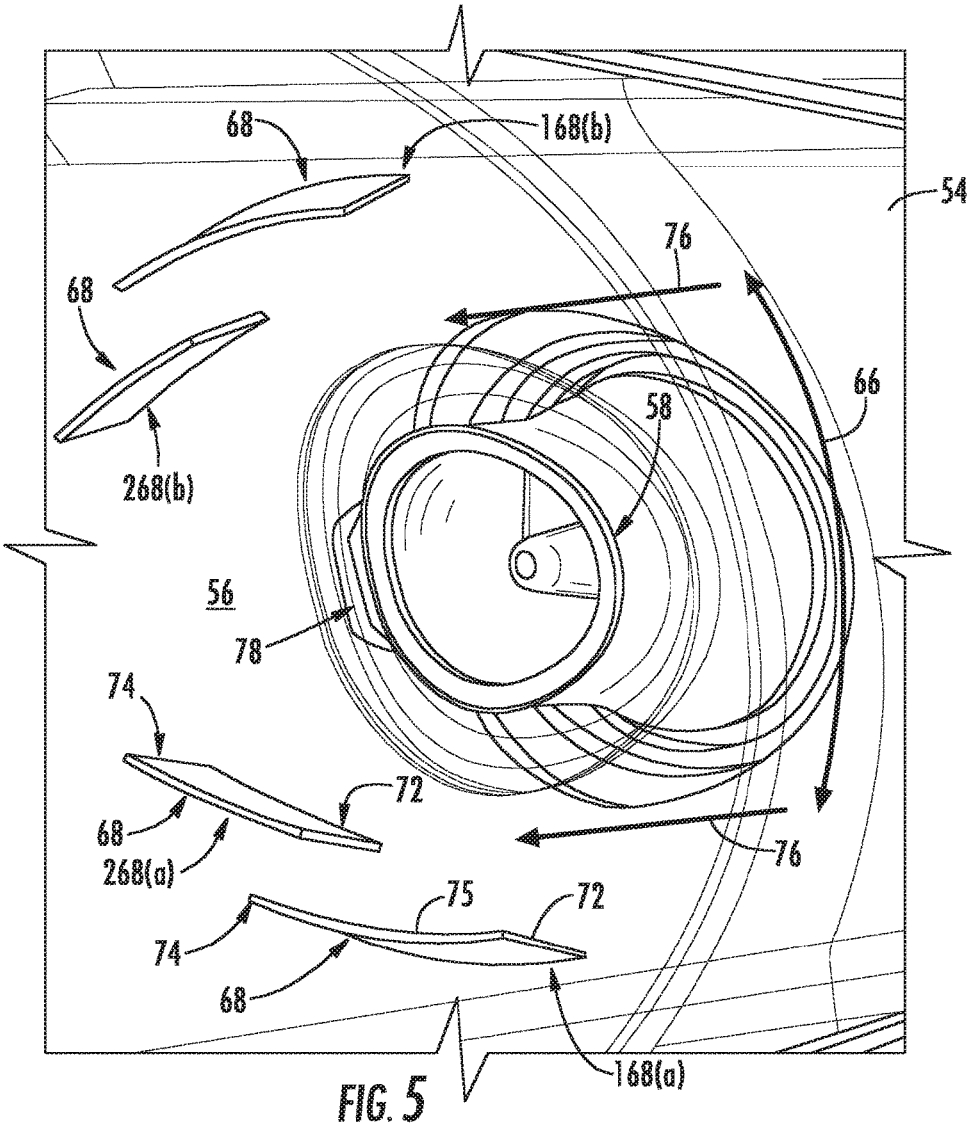
FIG. 5 is perspective bottom view of the flow sleeve as shown in FIG. 4, according to at least one embodiment of the present disclosure.

FIG. 4 is a simplified cross sectioned side view of a portion of the flow sleeve 54 as shown in FIG. 3 according to at least one embodiment. FIG. 5 is a bottom view of the flow sleeve 54 as shown in FIG. 3, according to at least one embodiment. In at least one embodiment, as shown collectively in FIGS. 3, 4 and 5, at least one guide vane 68 is disposed within the cooling flow annulus 56 and extends between the flow sleeve 54 and the liner 42 proximate to the bluff body 58. In at least one embodiment, as shown in FIGS. 3 and 4, at least one guide vane 68 extends radially through the flow sleeve 54 into the cooling flow annulus 56. In at least one embodiment, at least one guide vane 68 is fixedly connected to the flow sleeve 54. For example, the guide vane 68 may be brazed, welded, bolted or otherwise suitably attached to the flow sleeve 54. In one embodiment, as shown in FIG. 4, at least one guide vane 68 may include a tab 70 for aligning the respective guide vane 68 with the flow sleeve 54 and/or the cooling flow annulus 56.

In particular embodiments, as shown in FIG. 5, at least one guide vane 68 has an airfoil or turning shape including a leading edge 72, a trailing edge 74 and a pressure side wall 75 that extends therebetween. In one embodiment, the trailing edge 74 may be disposed downstream and axially spaced from the leading edge 72. In one embodiment, the leading edge 72 may be circumferentially offset from the bluff body 58 with respect to circumferential direction 66. In one embodiment, the leading edge 72 of at least one guide vane 68 may be disposed downstream or axially offset from the bluff body 58 with respect to a flow direction of a cooling medium flowing through the cooling flow annulus 56 as indicated by arrows 76 in FIG. 5.

In at least one embodiment, as shown most clearly in FIGS. 3 and 5, the combustor 16 includes a plurality of guide vanes 68 disposed within the cooling flow annulus 56. Each guide vane 68 of the plurality of guide vanes 68 extends between the flow sleeve 54 and the liner 42 proximate to the bluff body 58. As shown in FIG. 3, one or more of the bluff bodies 58 may comprise of an injector boss 60 or a fuel injector 62. At least one guide vane 68 of the plurality of guide vanes 68 may be fixedly connected to the flow sleeve 54. At least one guide vane 68 of the plurality of guide vanes 68 may extend radially through the flow sleeve 54 into the cooling flow annulus 56.

In various embodiments, each guide vane 68 of the plurality of guide vanes 68 may include a leading edge 72 and a trailing edge 74 disposed downstream from the leading edge 72. In one embodiment, the leading edge 72 of at least one guide vane 68 of the plurality of guide vanes 68 is circumferentially offset from the bluff body 58 with respect to circumferential direction 66. In at least one embodiment, the leading edge 72 of at least one guide vane 68 of the plurality of guide vanes 68 is disposed upstream from a downstream end or portion 78 of the bluff body 58 and the trailing edge 74 of the respective guide vane 68 is disposed downstream from the downstream end 78 of the bluff body 58 with respect to the flow direction of the cooling medium 76. In one embodiment, the leading edge 72 and the trailing edge 74 of at least one guide vane 68 of the plurality of guide vanes 68 is disposed downstream from the bluff body 58 with respect to the flow direction of the cooling medium 76.

In one embodiment, the plurality of guide vanes 68 includes a first subset of guide vanes 168 and a second subset of guide vanes 268. The second subset of guide vanes 268 is axially offset from the first subset of guide vanes 168 within the cooling flow annulus 56 with respect to axial centerline 48. In one embodiment, the first subset of guide vanes 168 comprises a pair of circumferentially spaced guide vanes 168(*a*), 168(*b*) and the second subset of guide vanes 268 comprises a pair of circumferentially spaced guide vanes 268(*a*), 268(*b*). In particular embodiments, the bluff body 58 is disposed between the pair of circumferentially spaced guide vanes 168 of the first subset.

Figure 6:
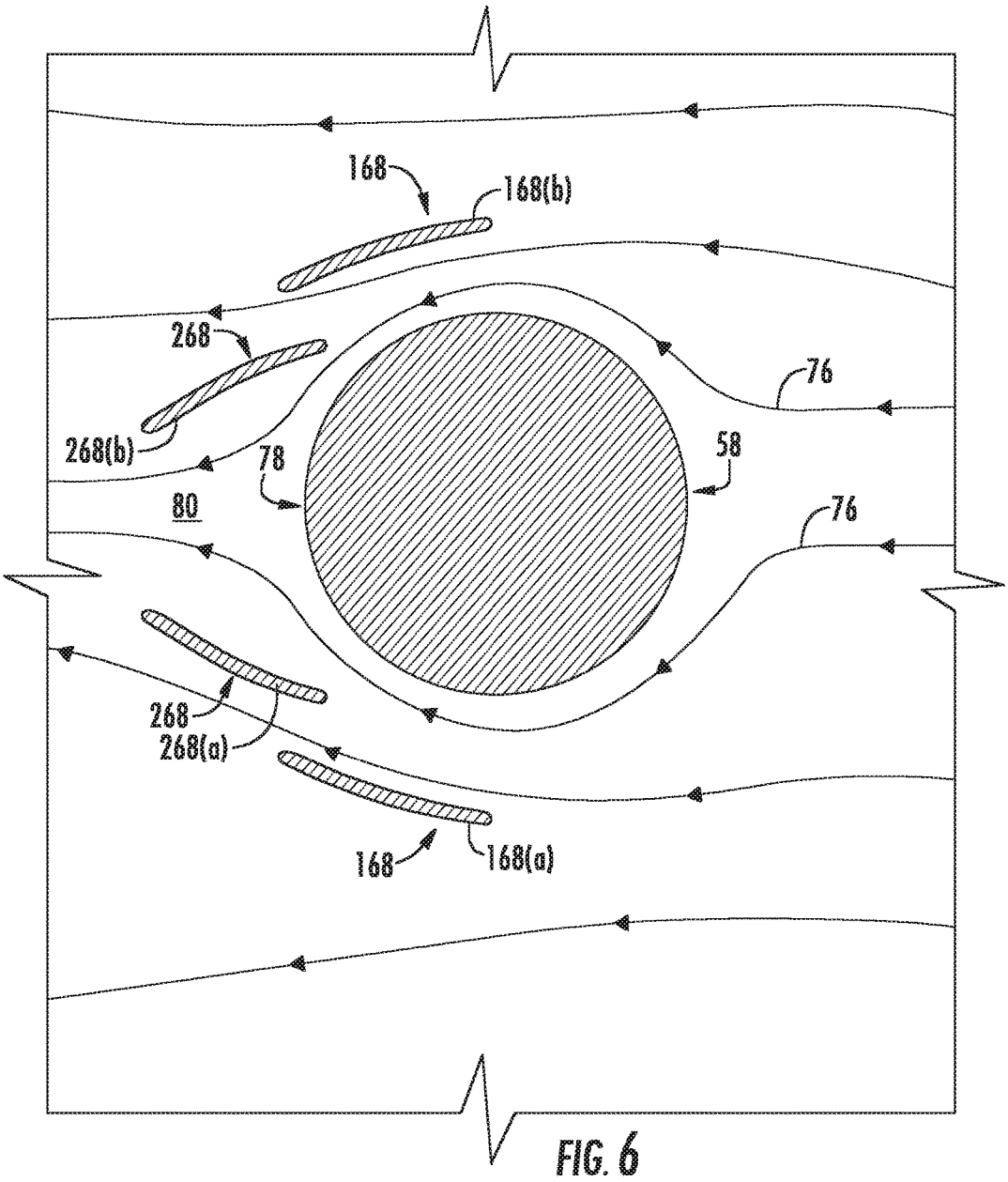
FIG. 6 is a flow schematic illustrating cooling flow through a cooling annulus formed between a liner and a flow sleeve of a combustor according to at least one embodiment.

FIG. 6 provides a flow schematic of a portion of the cooling flow annulus during operation of the combustor 16. During operation, the flow the cooling medium 76 enters the cooling flow annulus 56 upstream from the bluff body 58 or bluff bodies 58. The cooling medium 76 provides conduction, convection and/or impingement cooling to the liner 42. As the cooling medium 76 encounters each bluff body 58 a respective wake region 80 is formed just downstream from the respective bluff body 58. The guide vane 68 or guide vanes 168(*a*), 168(*b*) and 268(*a*) and 268(*b*) divert higher-momentum cooling medium flow moving around the respective bluff body 58 into the wake, thereby reducing or eliminating the potentially negative cooling effects otherwise associated with the wake created by the respective bluff body 58. As a result, the potential for hot spots or hot streaks formed at and just downstream from the respective bluff body 58 is reduced or eliminated, thereby enhancing thermal and mechanical performance of the liner 42.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A combustor, comprising:

an annularly shaped liner at least partially defining a hot gas path of the combustor;

a flow sleeve circumferentially surrounding at least a portion of the liner, wherein the flow sleeve is radially spaced from the liner to form a cooling flow annulus therebetween;

a bluff body extending radially between the flow sleeve and the liner through the cooling flow annulus, wherein the bluff body is one of an injector boss or a fuel injector;

a first guide vane disposed within the cooling flow annulus and extending between the flow sleeve and the liner proximate to the bluff body, the first guide vane comprising a leading edge and a trailing edge disposed downstream from the leading edge, wherein the leading edge of the first guide vane is disposed downstream from the bluff body; and a second guide vane disposed within the cooling flow annulus and extending between the flow sleeve and the liner proximate to the bluff body, the second guide vane comprising a leading edge and a trailing edge disposed downstream from the leading edge, wherein the leading edge of the second guide vane is disposed upstream from a downstream end of the bluff body and downstream from an upstream end of the bluff body and the trailing edge of the second guide vane is disposed downstream from the downstream end of the bluff body.

2. The combustor as in claim 1, wherein the first guide vane is fixedly connected to the flow sleeve and the second guide vane is fixedly connected to the flow sleeve.

3. The combustor as in claim 1, wherein the first guide vane extends radially through the flow sleeve into the cooling flow annulus and the second guide vane extends radially through the flow sleeve into the cooling flow annulus.

4. The combustor as in claim 1, wherein the leading edge of the second guide vane is circumferentially offset from the bluff body.

5. A combustor, comprising:

an annularly shaped liner at least partially defining a hot gas path of the combustor;

a flow sleeve circumferentially surrounding at least a portion of the liner, wherein the flow sleeve is radially spaced from the liner to form a cooling flow annulus therebetween;

a bluff body extending radially between the flow sleeve and the liner through the cooling flow annulus; and a plurality of guide vanes disposed within the cooling flow annulus, each guide vane of the plurality of guide vanes extending between the flow sleeve and the liner proximate to the bluff body, each guide vane of the plurality of guide vanes including a leading edge and a trailing edge disposed downstream from the leading edge, wherein the leading edge of at least one guide vane is disposed upstream from a downstream end of the bluff body and downstream from an upstream end of the bluff body and the trailing edge of the at least one guide vane is disposed downstream from the downstream end of the bluff body.

6. The combustor as in claim 5, wherein the bluff body is one of an injector boss or a fuel injector.

7. The combustor as in claim 5, wherein at least one guide vane of the plurality of guide vanes is fixedly connected to the flow sleeve.

8. The combustor as in claim 5, wherein at least one guide vane of the plurality of guide vanes extends radially through the flow sleeve into the cooling flow annulus.

9. The combustor as in claim 5, wherein the leading edge of at least one guide vane is circumferentially offset from the bluff body.

10. The combustor as in claim 5, wherein the leading edge and the trailing edge of at least one guide vane is disposed downstream from the bluff body.

11. The combustor as in claim 5, wherein the plurality of guide vanes includes a first subset of guide vanes and a second subset of guide vanes, wherein the second subset of guide vanes is axially offset from the first subset of guide vanes within the cooling flow annulus.

12. The combustor as in claim 5, wherein the plurality of guide vanes includes a first subset of guide vanes and a second subset of guide vanes, wherein the first subset of guide vanes comprises a pair of circumferentially spaced guide vanes and the second subset of guide vanes comprises a pair of circumferentially spaced guide vanes and wherein the bluff body is disposed between the pair of circumferentially spaced guide vanes of the first subset of guide vanes.

13. A gas turbine, comprising:

a compressor;

a turbine; and a combustor disposed downstream from the compressor and upstream from the turbine, the combustor comprising:

an annularly shaped liner at least partially defining a hot gas path of the combustor;

a flow sleeve circumferentially surrounding at least a portion of the liner, wherein the flow sleeve is radially spaced from the liner to form a cooling flow annulus therebetween; and a bluff body extending radially between the flow sleeve and the liner through the cooling flow annulus, wherein the bluff body is one of an injector boss or a fuel injector;

a first guide vane disposed within the cooling flow annulus and extending between the flow sleeve and the liner proximate to the bluff body, the first guide vane comprising a leading edge and a trailing edge disposed downstream from the leading edge, wherein the leading edge of the first guide vane is disposed downstream from the bluff body; and a second guide vane disposed within the cooling flow annulus and extending between the flow sleeve and the liner proximate to the bluff body, the second guide vane comprising a leading edge and a trailing edge disposed downstream from the leading edge, wherein the leading edge of the second guide vane is disposed upstream from a downstream end of the bluff body and downstream from an upstream end of the bluff body and the trailing edge of the second guide vane is disposed downstream from the downstream end of the bluff body.

14. The gas turbine as in claim 13, wherein the at first guide vane extends radially through the flow sleeve into the cooling flow annulus and the second guide vane extends radially through the flow sleeve into the cooling flow annulus.

15. The gas turbine as in claim 13, wherein the leading edge of the second guide vane is circumferentially offset from the bluff body.

* * * * *